United States Patent [19]

Obenshain

[11] 3,982,751

[45] Sept. 28, 1976

[54] PARALLEL ACTION JOGGER

[75] Inventor: David Noel Obenshain, Swanton, Md.

[73] Assignee: Westvaco Corporation, New York, N.Y.

[22] Filed: Sept. 16, 1975

[21] Appl. No.: 611,813

[52] U.S. Cl. ..... 271/221

[51] Int. Cl.[2] ..... B65H 31/38

[58] Field of Search ..... 271/221, 222, 210, 146; 214/65

[56] References Cited

UNITED STATES PATENTS

| | | | |
|---|---|---|---|
| 3,062,539 | 11/1962 | Obenshain | 271/210 |
| 3,733,070 | 5/1973 | Obenshain | 271/221 |

*Primary Examiner*—Johnny D. Cherry

*Assistant Examiner*—Bruce H. Stoner, Jr.

[57] ABSTRACT

A paper jogging device is disclosed for stacking sheets of paper or the like into precise alignment directly onto a shipping skid. The device employs a jogger paddle that is flexibly attached to a rigid supporting means, and that is driven so as to be vibrated back and forth over its entire surface. The drive means comprises a plurality of thrust members which are actuated by a pair of synchronized rotating eccentrics employing a novel modified "scotch-yoke" coupling mechanism. The novel features of the jogging device are, (1) the entire surface of the paddle moves back and forth simultaneously, (2) the forward motion terminates at a predetermined fixed position with reference to the supporting means, (3) the acceleration and deceleration of the paddle is a simple harmonic motion requiring minimum driving power, and (4) the entire operation is very quiet.

11 Claims, 8 Drawing Figures

PARALLEL ACTION JOGGER

BACKGROUND OF INVENTION

The device of the present invention relates in general to a vibratory apparatus and more particularly to a vibratory apparatus in the form of a jogging device for jogging sheets of paper or the like into an aligned stack.

In general, the jogger of the present invention may be used in combination with any suitable source of sheet material supply and it finds special utility in the field of stacking paper as received from such devices as web cutters or printing presses and the like.

With the web cutters and sheeters disclosed in some of the prior art, the cut sheets were not stacked directly onto a shipping skid, but were cut to oversized dimensions and later guillotine trimmed to the desired size. This method was necessary because the web cutters were not capable of making precise cuts and because the sheets were generally finally stacked on shipping skids, which were larger all around than the sheets, to prevent damage from the stack binding operation. However, along with the development of new high speed precision sheeters, particularly those disclosed in applicant's prior U.S. Pat. No. 3,203,326; 3,222,964; 3,272,044 and 3,363,520, including other related patents, it became obvious that the need was great for a jogging device for stacking machine finished paper directly onto its shipping skid.

While investigating the need for a useful jogging device, the applicant herein developed the high speed jogger disclosed in U.S. Pat. No. 3,062,539. The jogger of that invention gave the necessary precision for jogging, but it was use-limited since it was not adaptable for starting the stack of cut sheets on their own shipping skid. To overcome some of the problems inherent in the use of the jogger of U.S. Pat. No. 3,062,539, the applicant herein later on developed the floating jogger device disclosed in U.S. Pat. No. 3,733,070. However, that jogger also proved to be not completely successful since its pivoted paddle was not able to give good jogging action for the first few sheets coming onto the skid. Accordingly, the jogger of the present invention was developed to overcome the slight disadvantages of the previously described joggers while retaining all of their desirable features.

SUMMARY OF INVENTION

This invention relates to a vibratory apparatus for bringing the edges of sheets of paper or the like in a stack into an aligned condition. More particularly, the present invention provides for a mechanical jogger which quickly aligns sheets of paper as received on a stack into registry with the edges of the stack.

The device of the present invention aids in stacking cut sheets directly onto a shipping skid so that the stack can be immediately wrapped and prepared for shipment without the necessity of performing subsequent operations on the sheets. In addition, the jogger of the present invention is adapted to be mounted adjacent the shipping skid to permit a limited and automatic vertical movement of the jogging device, as the shipping skid is lowered, when the stack of cut sheets deposited on the shipping skid is started and grows in height.

For the purpose of carrying out the present invention, generally a plurality of joggers are required with one or more placed at each side of the stack. However, each jogger works independently of the other with its vibratory motion to produce the desired precisely aligned edges of the stack.

The jogging device of the present invention utilizes a vibrating paddle for jogging the sheets of paper as they are received on a stack. The vibratory motion of the paddle is produced by rotation of an eccentric bearing assembly which is suspended by a modified scotch-yoke mechanism between flexible eccentric springs and thrust springs. The thrust springs are connected between the jogger paddle and a rigid supporting means, and are driven by the eccentric bearing assembly. In addition, a pair of flexible stabilizer springs are also connected between the jogger paddle and the mounting means for the eccentric drive means for preventing vertical and/or rotational movement of the paddle. Thus the paddle has only one degree of freedom and its entire surface vibrates back and forth in a stroking motion substantially free of any lateral and/or rotational motions. The vibratory motion of the paddle depends upon the speed of rotaton of the drive means, but in general is quite rapid. The patting action of the paddles upon the edges of the sheets of paper received at the top of the stack, serves to align the edges of the sheets with those already comprising the stack. Where the sheet delivery level to the stack is relatively constant, the stack is preferably lowered by any suitable means to keep the top of the stack at the sheet delivery level as additional sheets are supplied to the stack, and the jogger device or devices are preferably arranged to rest on the shipping skid when the stacking operation begins, and then continue to automatically move downward with the stack for a limited distance during the initial stages of the stacking operation, or, until the stack reaches a state of equilibrium.

DETAILED DESCRIPTION

The preferred embodiment of the parallel action jogger of the present invention includes the following features, (1) the provision of a jogging paddle whose entire surface is free to vibrate with a simple back and forth stroke substantially free of any lateral and/or rotational motion, (2) the use of infinitely flexible, yet extremely durable spring elements between the jogger paddle, the jogger paddle drive means, and the jogger paddle mounting means, and (3) the provision whereby the jogging device can be mounted on a stacking skid when the stacking operation begins so as to provide jogging action to the first sheets, and then follow the stacking skid downward for a limited amount of vertical movement as additional cut sheets are deposited on the skid.

Figure 1:
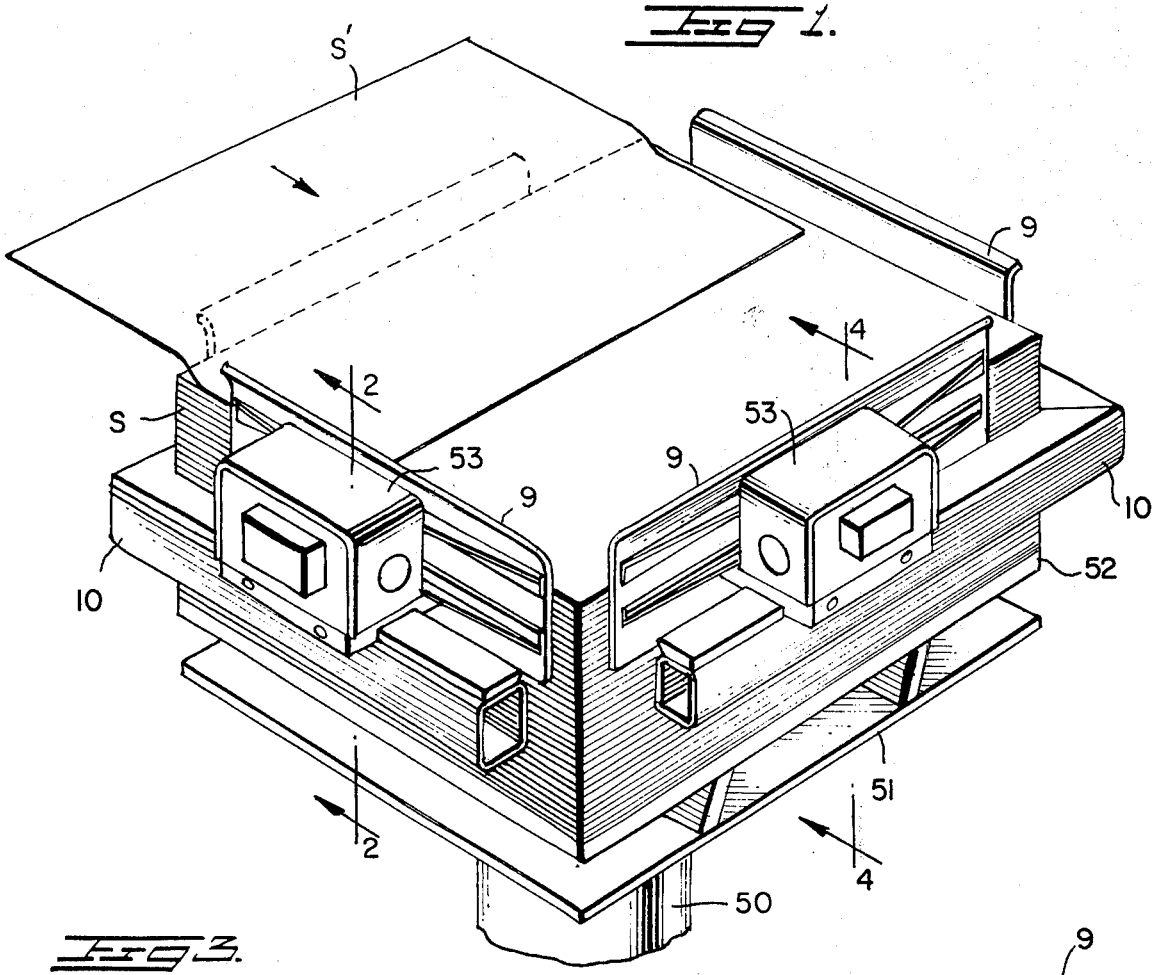
FIG. 1 is a perspective view of four jogging devices of the present invention arranged on the four sides of a stack during a stacking operation.

FIG. 1 shows a typical arrangement for the joggers of the present invention wherein separate jogger units 53 are arranged at each side of the sheet stack upon which the delivery device (not shown) delivers sheets S to the stack S. The joggers 53 are illustrated as being mounted on fixed side rails 10, however, the jogger units 53 are also capable of being mounted adjacent the stack in the manner particularly as disclosed in U.S. Pat. No. 3,733,070, the disclosure of which is incorporated herein by reference. Thus, when mounted as described in the aforementioned patent, the jogging devices 53 of the present invention would be able to float with the shipping skid substantially as disclosed hereinbefore. For the purpose of keeping the top of the shipping skid 52 substantially at a constant level, adjacent the delivery device for the sheets S, a hydraulic lift 50 and platform 51 is shown. In some instances, one or more of the jogging devices 53 could be removed from the stack S but in general one or more joggers are provided at each side of the stack to produce a uniform and aligned stack of paper.

The preferred material for the jogger paddles 9 of the jogging devices 53 is "ABCITE", a unique scratch resistant acrylic material that has among its advantages the ability to contact the sheets repeatedly and rapidly without scratching or otherwise marring the sheets. Moreover, because ABCITE is a transparent material, the machine operator is able to observe the paper stacking operation through an ABCITE jogging paddle. However, other similar synthetic materials could be used for the paddles 9, in addition to reasonably light metals such as anodized aluminum, with the same results.

Figure 3:
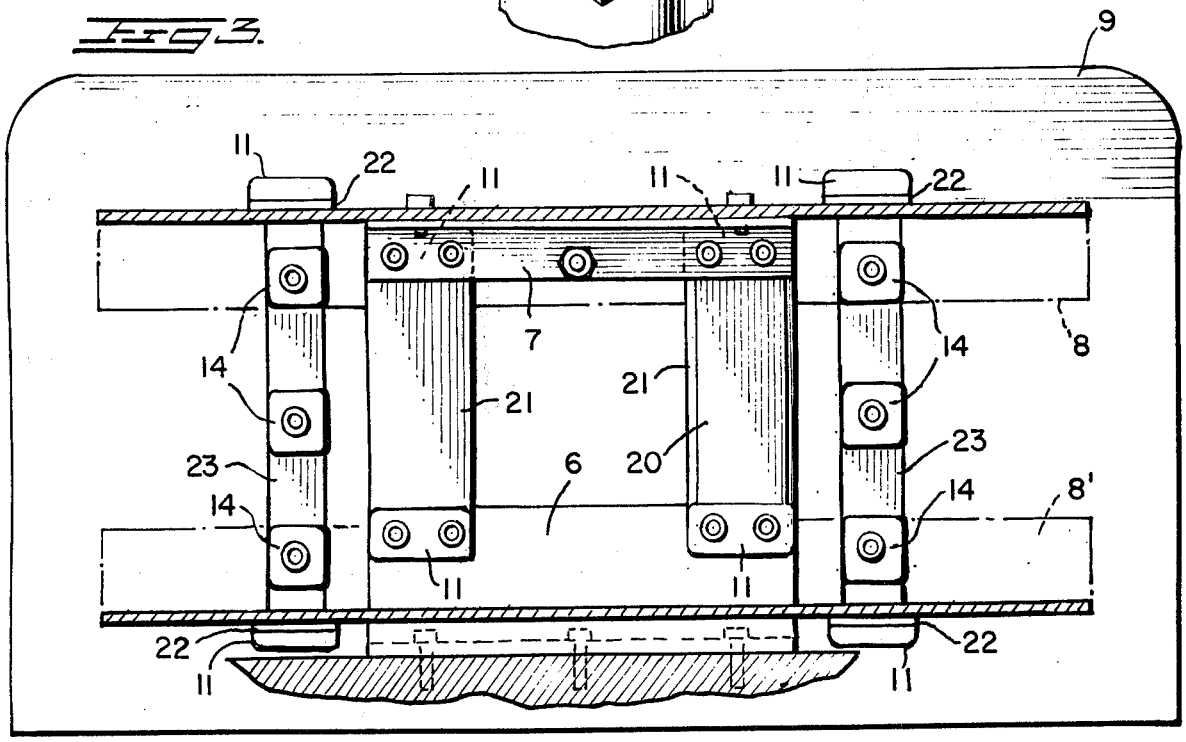
FIG. 3 is a frontal type view taken substantially along the lines 3—3 of FIG. 2 but showing the jogger paddle.
Figure 2:
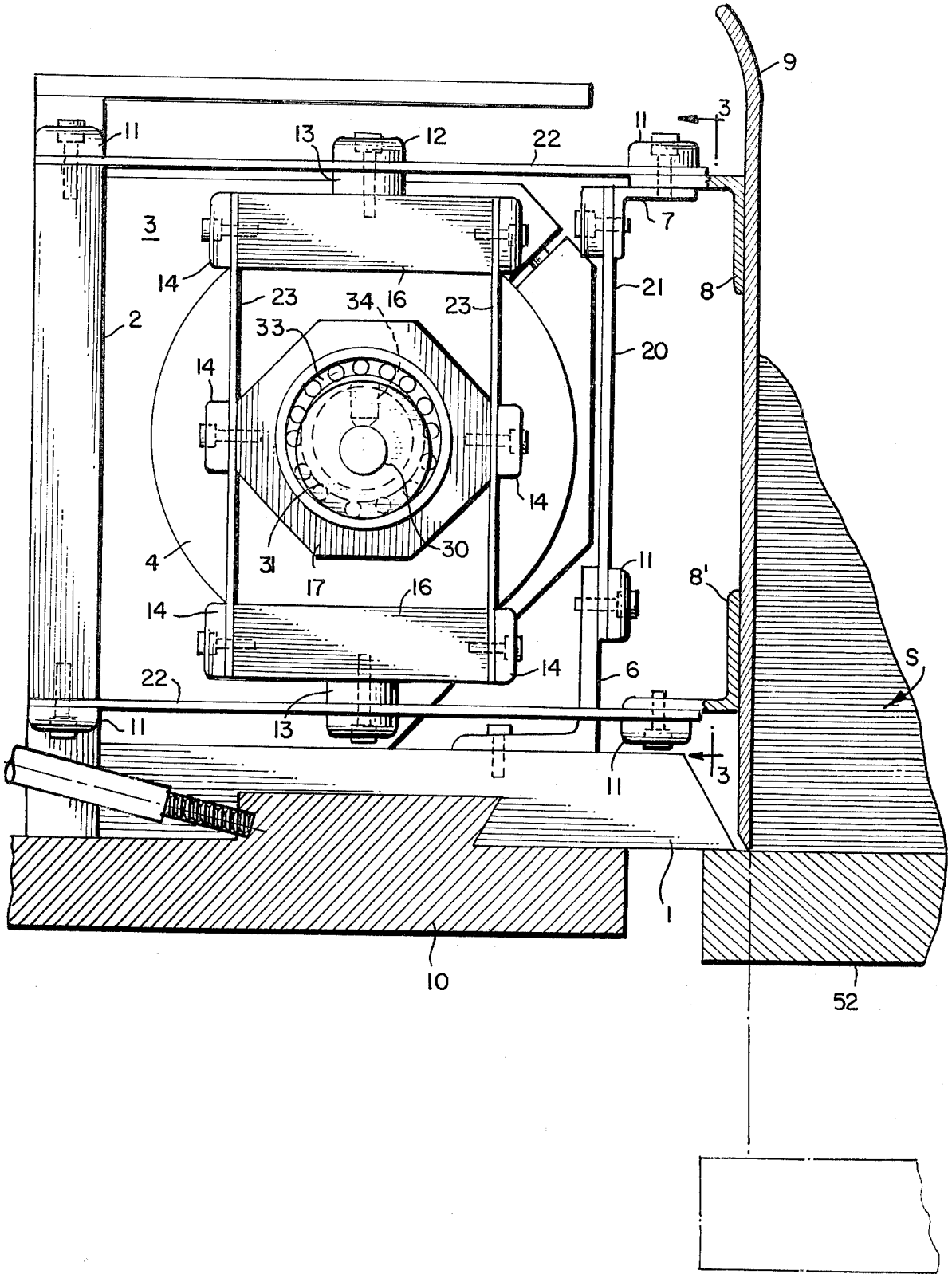
FIG. 2 is a composite section taken substantially along the lines 2—2 shown in FIG. 1.

FIGS. 2 and 3 illustrate the detailed features of one of the jogging devices 53 with greater particularity. For instance, in FIG. 2, a composite cross section shows the side rail 10 with back plate 2 and base plate 1 fixedly attached thereto. Base plate 1 is arranged at a right angle to the back plate 2 and together they provide a rigid support for the drive motor 4. Drive motor 4 is held in place by a pair of motor mounts 3 (FIG. 4) which encircle the motor. The motor mounts 3 are attached to the base plate 1 and back plate 2 and serve in this manner to tie the base and back plates rigidly together.

Figure 4:
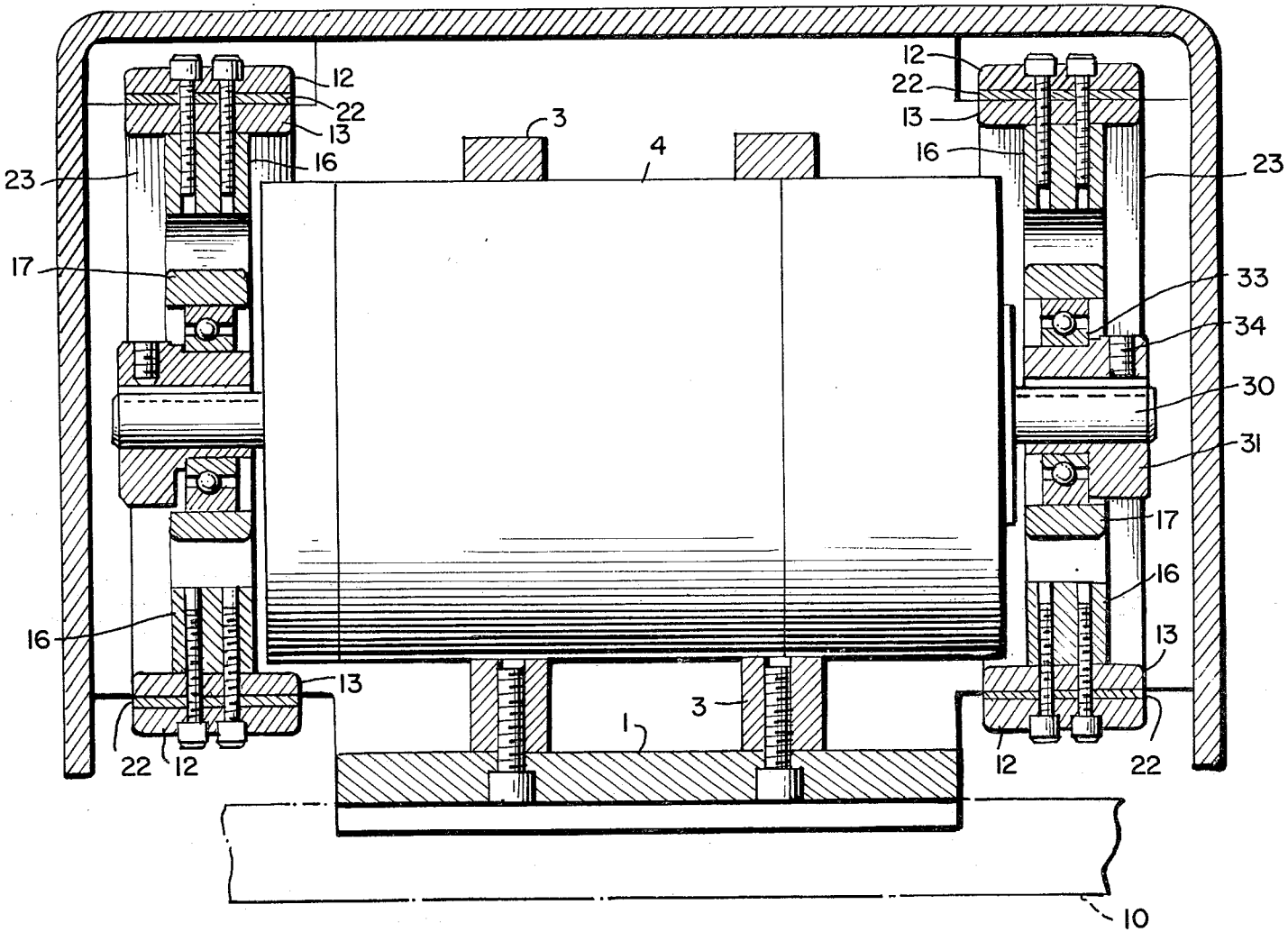
FIG. 4 is a sectional view taken substantially along the lines 4—4 of FIG. 1.

Drive motor 4, particularly as shown in FIG. 4, is preferably a double shaft D.C. motor of compact design. In use, the motors are supplied with ordinary household AC current through solid state SCR controllers. Such motors are quite efficient, give a wide range of speeds, and generally do not require extra cooling means even under the extreme operating conditions experience with the jogger installations. Each end shaft 30 of the drive motor 4 has attached thereto an eccentric disc 31 that rotates inside a housing 17 and is spaced therefrom by a bearing 33. When driven by the motor 4, the housings 17 at each side of the motor are displaced with an oscillating motion which is translated to the rest of the jogging paddle mounting system through the eccentric springs 23 and connecting bars 16. Note in FIGS. 2 and 3 that the eccentric springs 23 are arranged in fore and aft pairs at each side of the drive motor 4. In FIG. 4 note that the eccentrics 31 are synchronized and keyed to opposite ends of shaft 30 for maintaining exact alignment of the eccentrics.

Each eccentric spring 23 is attached substantially at its midpoint to the housing 17 by spring clamp plates 14. In addition the eccentric springs 23 are also attached top and bottom to the vertically spaced and horizontally disposed connecting bars 16 (FIG. 2) by spring plate clamps 14. Thus, when the synchronized eccentric discs 31 are driven by motor 4, the housings 17 transfer their oscillating motion to the connecting bars 16 by means of the flexible eccentric springs 23. Meanwhile, the jogger paddle element 9 is flexibly attached between the rigid back plate 2 and rigid base plate 1, and, to the connecting bars 16. For this purpose, the jogger paddle element 9 has attached thereto a pair of upper and lower jogger angle members 8 and 8', and the base plate 1 has attached thereto a stabilizer angle member 6.

Reference to FIG. 2 shows the manner for connecting the jogger paddle 9 to the back 2 wherein two pairs of thrust springs 22 are used. The thrust springs 22 like the eccentric springs 23 are preferably formed from a synthetic material that is durable and flexible. The preferred material is polypropylene, a material which has unusually good fatigue properties, permitting millions of flexures before failure. In one installation of the present invention, the polypropylene thrust and eccentric springs were used for about 6 months, during which time the springs were estimated to have flexed around 400 million times without failure. FIG. 3 shows the thrust springs 22 arranged in top and bottom pairs at each side of the drive motor 4. Thus, as shown, the thrust springs 22 and eccentric springs 23 are arranged in common planes at each side of motor 4. The upper or top thrust springs 22 are connected between the back plate 2 and the upper jogger angle member 8 by spring clamp plates 11. Meanwhile, the lower or botton thrust springs 22 are similarly connected between the back plate 2 and lower jogger angle member 8'. Each of the upper and lower thrust springs 22 are also connected substantially at their midpoints to the connecting bars 16 by additional spring plate clamps 12 and the spacer blocks 13. Thus, the oscillating movement of the eccentric housing 17 is transferred to the eccentric springs 23 and connecting bars 16 and onto the thrust springs 22 and finally to the paddle element 9.

However, in order to prevent any vertical or rotational movement of the jogger paddle 9 in response to the eccentric oscillating motion just described, a pair of stabilizer springs 21 are attached between the upper jogger angle member 8 and a stabilizer mount 6 to the base plate 1 particularly as shown in FIG. 2. The stabilizer springs 21 are arranged as shown in FIG. 3 in planes which are inboard of the planes of the eccentric and thrust springs 23, 22 but such an arrangement would not necessarily be required. In the embodiment shown, the offset arrangement is dictated because of space limitations. In addition, the stabilizer springs 21 like the thrust and eccentric springs 22, 23 are preferably made from a flexible synthetic material such as polypropylene. However, materials other than polypropylene, such as steel springs could be used as long as the material had a constant flex resistance and good durability.

FIG. 4 shows in somewhat greater detail the eccentric drive mechanism of the present invention. The eccentric discs 31 are illustrated as being keyed at each end of motor 4 to the motor shaft 30 and are held in place by the set screws 34. Bearings 33 are also shown between the eccentric discs 31 and the housings 17. Meanwhile, the drive motor 4 is shown as being rigidly clamped by motor mounts 3 to the base plate 1. Therefore, when the motor is actuated to drive the shafts 30, the eccentric discs rotate producing an oscillating motion to the housings 17. The oscillating motion is transferred to the eccentric springs 23 and connecting blocks 16, to the thrust springs 22, and finally to a plurality of spaced apart points on the jogger paddle 9 to insure an even motion to the entire surface of the jogger paddle. Of course, as described hereinbefore, the oscillating motion of the eccentric drive is not communicated undiminished and unchanged to the jogger paddle 9 because of the presence of the stabilizer springs 21. The stabilizer springs only permit one degree of freedom of movement of the jogger paddle, i.e., back and forth. The arrangement of the thrust springs 22, connecting bars 16 and eccentric springs 23, along with their connection to the housings 17, effectively translates the oscillating movement of the housings 17 into a fore and aft movement of the jogger paddle 9. The system employed is a modified scotch-yoke type mechanism which yields a substantially simple harmonic motion to the jogger paddle 9. Minimum power is required to drive the mechanism and smooth acceleration and deceleration are inherent traits of the drive. It will also be noted that spring pivots are employed throughout the mechanism and the combination of all of the above features results in a very quiet operation with minimum noise pollution.

In at least one form that was used in an actual jogging operation, a D.C. motor of ⅛ hp at 1750 rpm was employed to actuate a jogger paddle made of Abcite. The jogger paddle was about 16 inches (40.6 cm) long and 9 inches (22.8 cm) high. The entire mechanism from back plate to paddle was about 8 inches (20.3 cm) deep by about 8 inches (20.3 cm) high. The thrust springs measured approximately 7 inches (17.8 cm) by 1½ inches (3.8 ) and were approximately 3/32 inch (0.24 cm) thick. Eccentric springs were 1/16 inch (0.16 cm) thick and ¾ inch (1.91 cm) wide and about 5 inches (12.7 cm) long. The stabilizer springs were also about 5 inches (12.7 cm) long, 1½ inches (3.8 cm) wide and about 3/32 inch (0.24 cm) thick. The eccentric throw or offset for the eccentric discs 31 was about ⅛ inch (0.32 cm) to produce a paddle movement of about 1/32 inch (0.08 cm). The jogger device so constructed produced very satisfactory performance.

Figure 5:
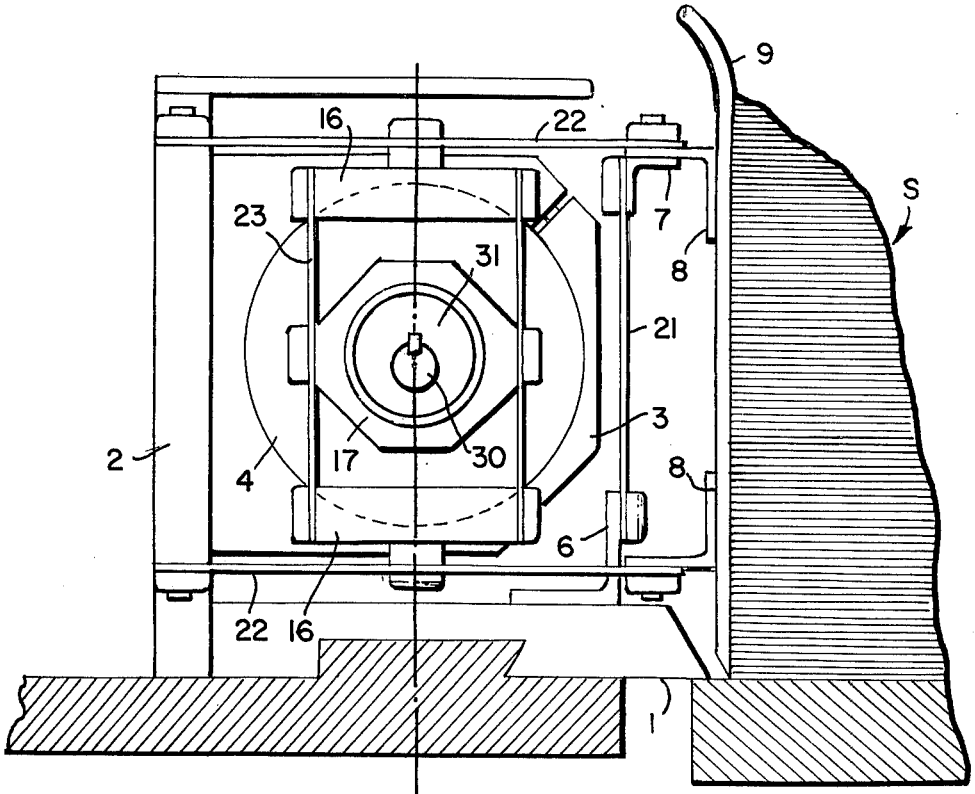
FIG. 5 is a schematic view of the jogging device showing the eccentric drive and the jogger paddle in its most forward position.
Figure 6:
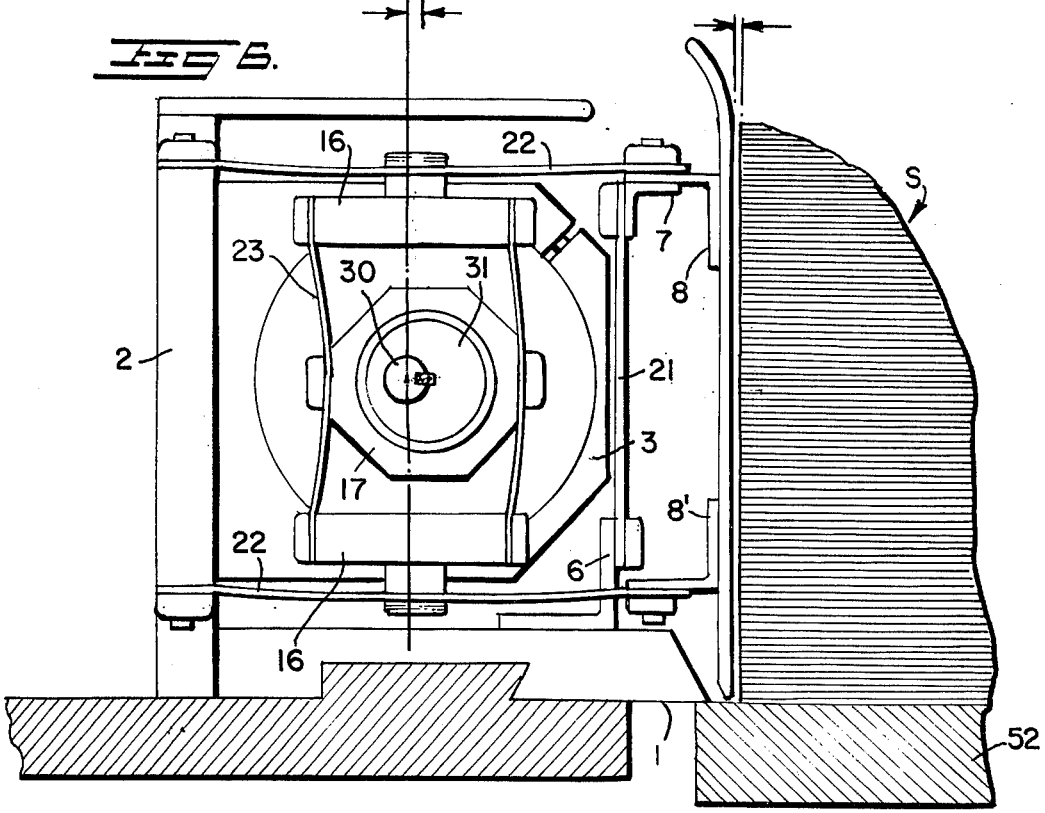
FIG. 6 is a schematic view substantially as shown in FIG. 5 after 90° of rotation of the eccentric drive showing the jogger paddle partially retracted.
Figure 7:
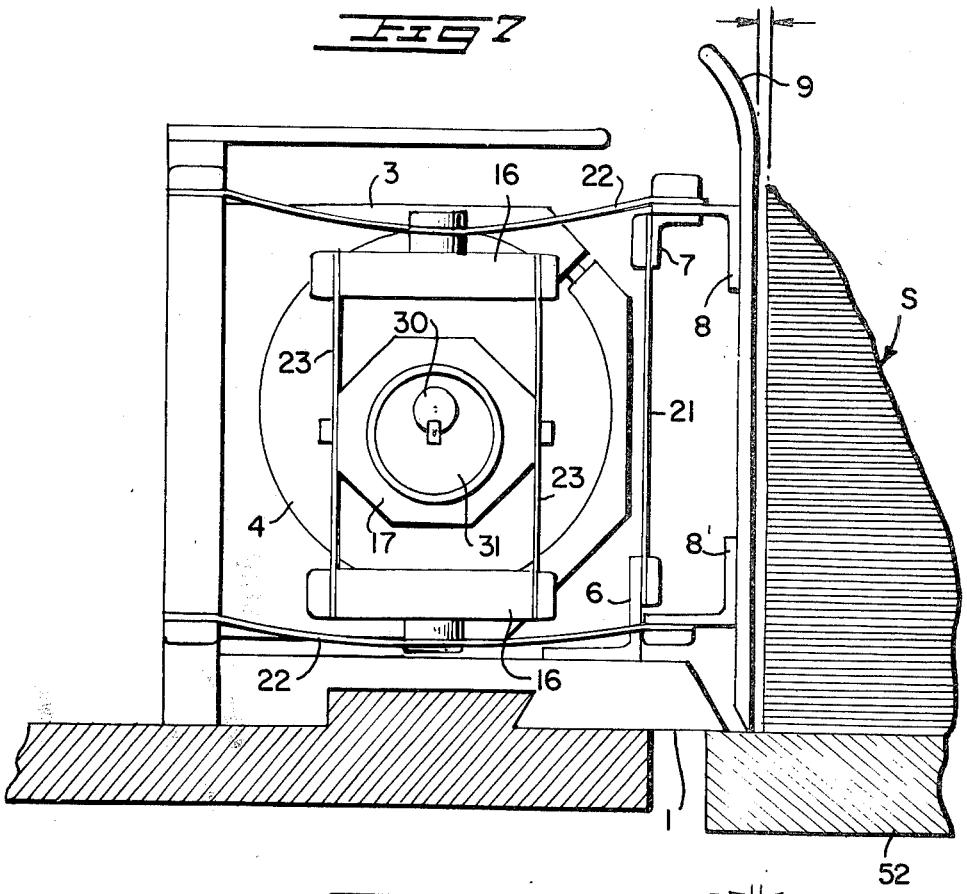
FIG. 7 is a schematic view substantially as shown in FIG. 5 after 180° rotation of the eccentric drive showing the jogger paddle fully retracted; and, FIG. 8 is a schematic view substantially as shown in FIG. 5 after 270° of rotation of the eccentric drive showing the jogger paddle returned to its partially retracted condition.
Figure 8:
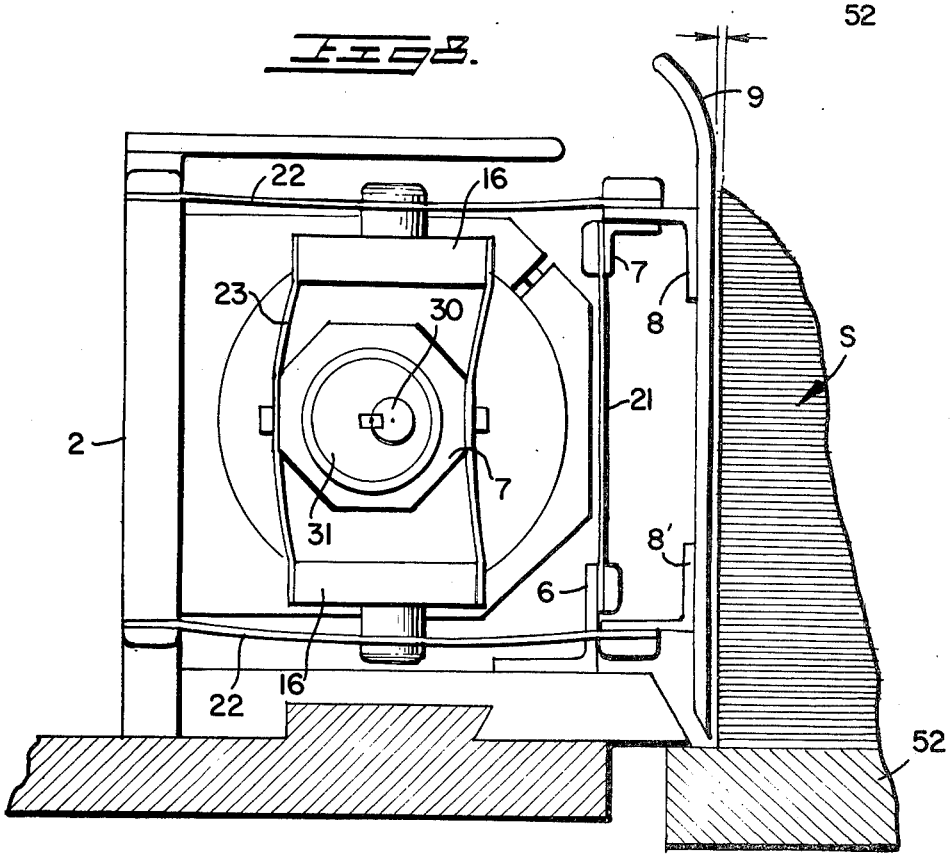

In order to understand the operation of the present invention reference may be made to the schematic showing in FIGS. 5–8. In FIG. 5, the eccentrics 31 are in their uppermost position and the thrust springs 22 are straight. This condition is arranged to provide maximum forward motion to the paddle 9, therefore, the paddle is shown touching the stack S. In FIG. 6, the eccentrics 31 have rotated 90 degrees clockwise to urge the eccentric springs 23 forward (toward the paddle) and pull the thrust springs 22 downward. In this condition, the paddle 9 is moved away from the stack a slight distance since the stabilizer springs 21 prevent any rotational movement of the paddle. In FIG. 7, the eccentrics 31 have rotated another 90° clockwise (or 180° from their initial position) to return the eccentric springs 23 back to their neutral position, but at the same time urge the thrust springs to an even greater downward movement than that experienced in FIG. 6. This condition produces the maximum movement of the paddle 9 away from the stack (approximately 1/32 inch), once again because the stabilizer springs prevent any rotational movement of the paddle 9. In FIG. 8, the eccentrics 31 have rotated another 90° cloockwise (270° from the initial position in FIG. 5) to urge the eccentric springs 23 to their most aft position and consequently begin to pull the thrust springs back to their partially deflected condition as shown in FIG. 6. This condition produces a location of the paddle 9 substantially like that shown in FIG. 6 with the paddle beginning to travel from its maximum displaced condition (FIG. 7) back toward the paper stack S. Finally, with another 90° of rotation of the eccentrics 31, the eccentrics 31 and the paddle return once again to their initial position shown in FIG. 5 with the paddle touching the stack.

In the preferred embodiment, the paddle is adjusted upwards by means of slotted holes in the tops of the stabilizer springs 23 to give a clearance of between about 0.03 and 0.04 inch (0.07–0.10 ) above the bottom of the base plate 1. This arrangement permits unrestricted movement of the jogger paddle when the base plate 1 is resting on the edge of the skid 52.

While only a preferred embodiment of the invention has been illustrated and described in detail, it is to be understood that various changes may be made therein within the scope of the appended claims.

I claim:

1. A sheet jogging device for precisely aligning cut sheets of material in a stack comprising:

a. a supporting means for a jogger device comprising a base member and back plate connected to one another;

b. a jogger paddle element attached to said supporting means by a first flexible spring device connected between said jogger paddle and said back plate and a second flexible spring device connected between said jogger paddle and said base member; and, c. a drive means mounted on said supporting means and connected to said first flexible spring device for actuating said jogger paddle element.

2. The device recited in claim 1 wherein said drive means comprises a double shafted motor fixedly attached to both said base member and said back plate.

3. The device recited in claim 2 wherein said first flexible spring device further comprises at least two pairs of flexible thrust springs arranged in top and bottom pairs at each end of said double shaft motor.

4. The device recited in claim 3 wherein an eccentric drive device is fixedly attached to said drive motor shaft at each end of said double shafted motor.

5. The device recited in claim 4 wherein each eccentric drive device further comprises an outer housing member and an eccentric disc fixed to the drive motor shaft and adapted to rotate within said outer housing member.

6. The device recited in claim 5 wherein each outer housing member has attached thereto a pair of eccentric spring elements arranged at right angles to said thrust springs, and fixedly attached to said thrust springs.

7. The device recited in claim 6 wherein said first flexible spring device, said second flexible spring device and said eccentric spring elements are each fabricated from polypropylene straps.

8. The device recited in claim 7 wherein said base member and back plate are each attached to fixed side rails.

9. The device recited in claim 7 wherein said base member and back plate are each attached to side rails that are adapted for limited vertical movement,

10. An apparatus for precisely aligning cut sheets of material in a stack comprising a plurality of sheet jogging devices arranged at each side of a stack, each jogging device being adapted to be driven to produce a vibratory fore and aft motion to a jogger paddle element attached thereto said jogging devices each further comprising:

a. a base member and back plate connected to one another at a right angle and attached to a side rail adjacent each side of said stack;

b. a double shafted drove motor located between said base member and back plate and fixedly attached to both said base member and back plate;

c. a pair of eccentric drive devices, one fixedly attached to said drive motor shaft at each end of said double shafted motor;

d. a jogger paddle element located opposite the right angle connection between said base member and back plate and spaced from said base member and back plate;

e. a first flexible spring means attached between said jogger paddle element and said back plate;

f. a second flexible spring means attached between said jogger paddle element and said base member; and, g. a third flexible spring means attached between said first spring means and said eccentric drive devices.

11. Apparatus for receiving and stacking cut sheets of material such as paper in a stack comprising, in combination, a skid for receiving the cut sheets and at least one sheet jogging device arranged at one side of said stack for precisely aligning the edges of said stack, said jogging device being adapted to rest on top of the skid when the stacking operation begins and then follow the skid downwardly for a limited vertical distance during the initial stage of operation, the improvement comprising:

a. a supporting means for said jogging device comprising a base member and back plate connected to one another;

b. a double shafted drive means located between said base member and back plate and fixedly attached to both said base member and back plate;

c. a pair of eccentric drive devices, one fixedly attached to said drive means at each end of said drive means;

d. a jogger paddle element located opposite and spaced from said base member and back plate;

e. a first flexible spring means attached between said jogger paddle element and said back plate;

f. a second flexible spring means attached between said jogger paddle element and said base member; and g. a third flexible spring means attached between said first spring means and said eccentric drive devices.

* * * * *